United States Patent [19]

Bridwell et al.

[11] 4,307,991

[45] Dec. 29, 1981

[54] SWING MOTOR MOUNTING ARRANGEMENT

[75] Inventors: John W. Bridwell, Morton; Sterling R. Booth, Jr., Yates City, both of Ill.

[73] Assignee: Caterpillar Tractor Co., Peoria, Ill.

[21] Appl. No.: 195,721

[22] PCT Filed: Mar. 13, 1980

[86] PCT No.: PCT/US80/00266

§ 371 Date: Mar. 13, 1980

§ 102(e) Date: Mar. 13, 1980

[87] PCT Pub. No.: WO81/02596

PCT Pub. Date: Sep. 17, 1981

[51] Int. Cl.[3] ..... E02F 3/75

[52] U.S. Cl. ..... 414/687; 414/694

[58] Field of Search ..... 414/687, 694, 695; 92/121

[56] References Cited

U.S. PATENT DOCUMENTS

| | | | |
|---|---|---|---|
| 3,174,635 | 3/1965 | Van Aowelaer et al. | 414/695 |
| 3,243.053 | 3/1966 | Hanser et al. | 414/695 X |
| 3,270,894 | 9/1966 | Elliott et al. | 414/695 X |
| 3,758,941 | 9/1973 | Jackson et al. | 414/687 X |
| 3,929,239 | 12/1975 | Shumaker | 414/694 |
| 4,049,139 | 9/1977 | Stedman | 414/694 |
| 4,140,232 | 2/1979 | Myers et al. | 414/695 |

*Primary Examiner*—Sherman D. Basinger
*Assistant Examiner*—Terrance L. Siemens
*Attorney, Agent, or Firm*—Phillips, Moore, Weissenberger, Lempio & Majestic

[57] ABSTRACT

Swing motors employed on backhoes and like constructions vehicles are interconnected between a tractor frame and a mast frame to selectively rotate the mast frame relative to the tractor frame. In addition to posing assembly and disassembly problems, conventional mounting arrangements for swing motors of this type oftentimes subject various spline connections, pins, and bearings to undue wear. The swing motor mounting arrangement (10) of this invention overcomes the above problems by providing a pair of first brackets (20) fro pivotally mounting a mast frame (15) on a tractor frame (16) and a pair of second brackets (26) for securing opposite ends (14) of a shaft (13) of a swing motor (11) to the mast frame (15). A housing of the swing motor (11) is connected to the tractor frame (16) whereby pressurization of the motor will rotate the shaft (13) relative to the housing (12) to selectively swing the mast frame (15) relative to the tractor frame (16).

7 Claims, 3 Drawing Figures

SWING MOTOR MOUNTING ARRANGEMENT

DESCRIPTION

1. Technical Field

This invention relates generally to a swing motor mounting arrangement and more particularly to a swing motor connected between a vehicle frame and a mast frame for selectively swinging the mast frame relative to the vehicle frame.

2. Background Art

Construction vehicles, such as backhoes, include a swing motor mounted between a tractor frame and a mast frame for selectively swinging a boom attached to the mast frame to various work positions. It has proven desirable to provide a mounting arrangement for the swing motor whereby the motor may be expeditiously installed and removed for repair or replacement purposes. In addition, the mounting arrangement should exhibit sufficient structural integrity to prevent undue wear of component parts thereof, such as spline connections, pins, and bearings. Swing motor mounting arrangements of this type are disclosed in U.S. Pat. No. 3,758,941, issued to James S. Jackson et al. on Sep. 18, 1973.

The present invention is directed to overcoming one of more of the problems as set forth above.

DISCLOSURE OF INVENTION

In one aspect of the present invention, a swing motor mounting arrangement includes first and second pivotally interconnected frames with a housing of a swing motor being secured to the first frame, and with a shaft of the motor being exposed at opposite ends of the housing. The improved mounting arrangement further includes a pair of spaced first bracket means for pivotally mounting and supporting the second frame on the first frame independent of the motor, and a pair of spaced second bracket means for securing opposite ends of the motor shaft to the second frame directly, independent of the first bracket means.

The above swing motor mounting arrangement is thus adapted for expeditious assembly and disassembly for repair or replacement purposes. In addition, the first and second bracket means provide a structurally integrated arrangement for protecting various spline connections, pins, and bearings of the mounting arrangement against undue wear to prolong the service life thereof.

BRIEF DESCRIPTION OF DRAWINGS

Other advantages and objects of this invention will become apparent from the following description and accompanying drawings wherein.

BEST MODE OF CARRYING OUT THE INVENTION

Figure 1:
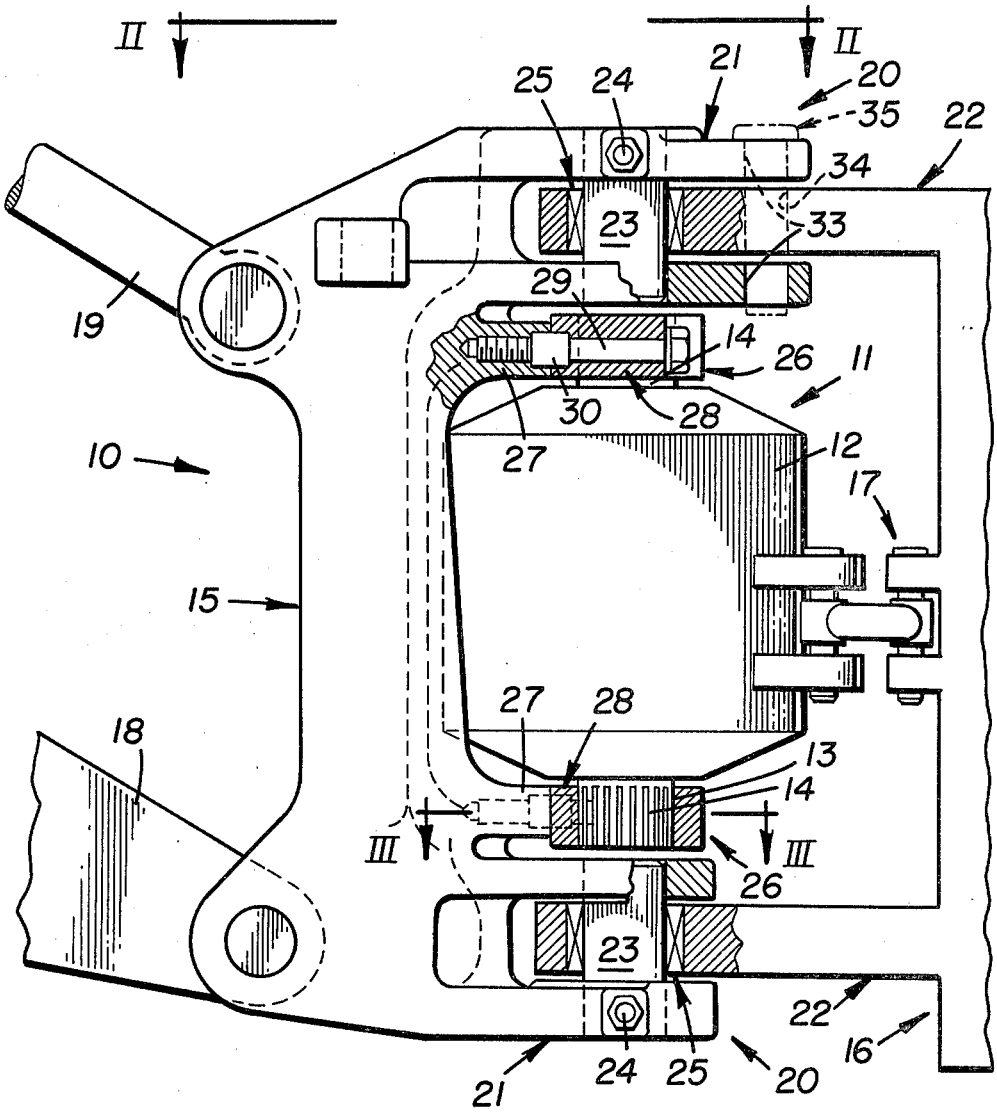
FIG. 1 is a side elevational view of a swing motor mounting arrangement embodiment of the present invention.

FIG. 1 illustrates a swing motor mounting arrangement 10 comprising a swing motor 11 having a housing

12 and a shaft 13 rotatably mounted in the housing. Opposite ends 14 of shaft 13 project beyond housing 12 in exposed relationship and are secured to a mast frame 15 in a manner hereinafter described. Motor housing 12 is secured to a frame 16 of a tractor or the like by a connection 17 and mast frame 15 is pivotally mounted on tractor frame 16 whereby rotation of shaft 13 relative to housing 12 will selectively swing mast frame 15 horizontally relative to tractor frame 16 to various work positions.

Mast frame 15 has a boom 18 pivotally mounted thereon, along with a rod 19 of a double-acting hydraulic cylinder connected to a dipper stick (not shown) pivotally mounted on the boom. Swing motor 11 has at least one vane (not shown) secured on shaft 13 to selectively rotate the shaft relative to housing 12 in response to communication of pressurized hydraulic fluid therein.

Figure 2:
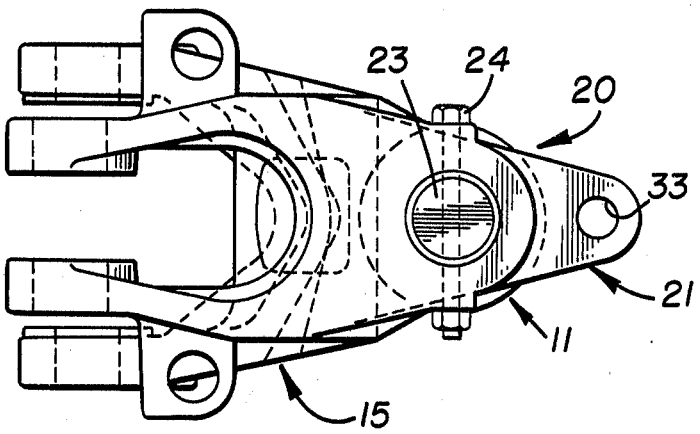
FIG. 2 is a top plan view of the mounting arrangement, taken in the direction of arrows II—II in FIG. 1.
Figure 3:
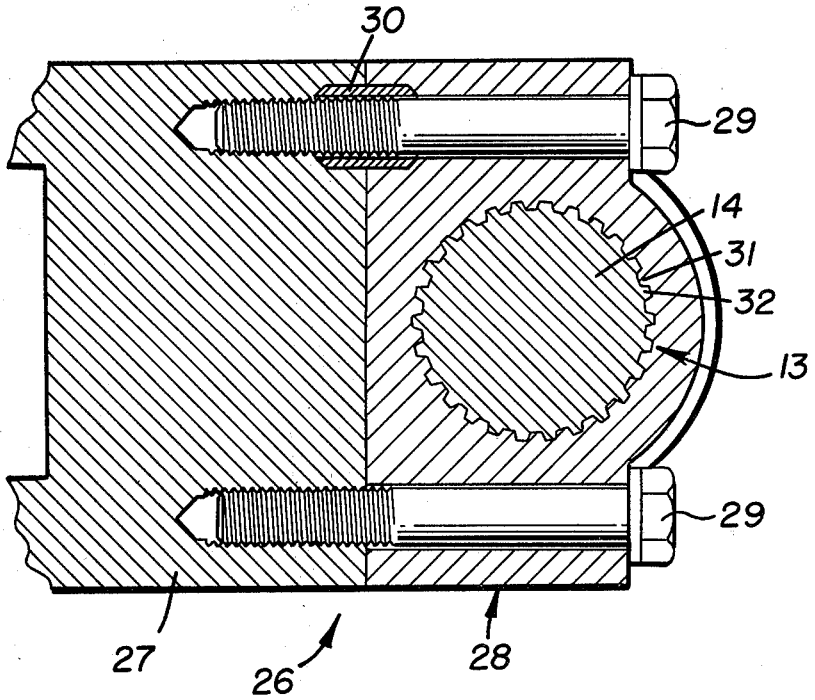
FIG. 3 is an enlarged sectional view of a spline connection of the mounting arrangement, taken in the direction of arrows III—III in FIG. 1.

A pair of vertically spaced first bracket means 20, similar in construction and arrangement, pivotally mount mast frame 15 on tractor frame 16 and provide a highly structurally integrated connection therebetween. As shown in FIGS. 1 and 2, each bracket means 20 includes a bifurcated bracket 21 secured on mast frame 15 to extend rearwardly therefrom, a single bracket 22 secured on tractor frame 16 to extend rearwardly therefrom, and a pivot pin 23. Pivot pin 23 is suitably secured to bracket 21 by a bolt 24 extending through an upper arm of bracket 21 and pivot pin 23. Pivot pin 23 is further mounted in an annular bearing 25 to facilitate relative pivoting between frames 15 and 16 and is aligned vertically with respect to shaft 13 and the other pivot pin 23. Referring to FIGS. 1 and 3, opposite ends 14 of motor shaft 13 are secured to mast frame 15 by a pair of vertically spaced second bracket means 26. Each bracket means 26 includes a bracket 27 secured to mast frame 15 to extend rearwardly therefrom and a plate 28, shown in the form of a cap, releasably secured to bracket 27 by fastening means shown in the form of a pair of bolts 29. If so desired, a tubular centering dowel 30 may be inserted between bracket 27 and plate 28 to aid in the securance of each bolt 29 to bracket 27, as shown in FIG. 3.

Each plate 28 has spline teeth 31 formed therethrough to engage similar spline teeth 32 formed on a respective end 14 of motor shaft 13. It can be seen in FIGS. 1 and 2 that expeditious and precise mounting of motor 11 on mast frame 15 is facilitated by allowing plates 28 to be initially secured to the ends of motor shaft 13 at splines 31, 32 and by thereafter securing the plates to brackets 27 by bolts 29. Subsequently, brackets 22 of tractor frame 16 may be properly positioned within bifurcated brackets 21 of mast frame 15 to permit pivot pins 23 to be secured in place by bolts 24 and also to permit attachment of motor housing 12 to tractor frame 16 by connection 17. As further shown in FIG. 1, aligned bores 33 and 34 may be formed through brackets 21 and 22, respectively, to releasably receive a swing lock pin 35 therein to lock mast frame 15 against swinging movements relative to tractor frame 16 during roading of the vehicle, for example.

INDUSTRIAL APPLICABILITY

Swing motor mounting arrangement 10 finds particular application to backhoes which include mast frame 15, adapted for swinging movements on tractor frame 16 in response to actuation of swing motor 11. Although frame 16 has been referred to as a "tractor frame," it should be understood that in many backhoe applications frame 16 would constitute a mounting frame slidably mounted for lateral movements on a tractor frame proper to permit selective positioning and locking of mast frame 15 at a desired lateral position at the rearward end of the tractor.

In operation, an operator desiring to swing mast frame 15 relative to tractor frame 16 would actuate the proper control lever (not shown) to communicate pressurized hydraulic fluid to motor 11. Since motor housing 12 is secured to tractor frame 16 at connection 17, motor shaft 13 will rotate relative to housing 12 to effect such swinging movement of mast frame 15. It should be particularly noted that vertically spaced mounting means 20 will function to support the weight of mast frame 15 and its attendant components, such as boom 18 and the dipper stick and bucket, to ensure that spline connections 31, 32 and motor 11 proper will remain in a stress-relieved condition of operation. Otherwise stated, the primary function of the spline connections is to pivot mast frame 15 on tractor frame 16, and no adverse loads are imposed thereon during operation of the backhoe since such loads will be absorbed by heavy-duty mounting means 20.

Other aspects, objects, and advantages of this invention can be obtained from a study of the drawings, the disclosure, and the appended claims.

We claim:

1. In a swing motor mounting arrangement (10) having a motor (11) including a housing (12) and a shaft (13) rotatably mounted in said housing (12), opposite ends (14) of said shaft (13) exposed at opposite ends of said housing (12), a first frame (16) having said housing (12) secured thereto, and a second frame (15) pivotally mounted on said first frame (16), the improvement comprising a pair of spaced first bracket means (20) for pivotally mounting and supporting said second frame (15) on said first frame (16) independent of said motor and a pair of spaced second bracket means (26) for securing the opposite ends (14) of said shaft (13) to said second frame (15) directly, independent of said first bracket means (20).

2. The swing motor mounting arrangement (10) of claim 1 wherein said first frame includes a tractor frame (16) and wherein said second frame includes a mast frame (15) having a boom (18) pivotally mounted thereon.

3. The swing motor mounting arrangement (10) of claim 1 wherein each of said first bracket means (20) includes a bifurcated bracket (21) secured to said second frame (15) to extend rearwardly therefrom, a single bracket (22) secured to said first frame (16) to extend rearwardly therefrom and within said bifurcated bracket (21), and a pivot pin (23) pivotally connecting said bifurcated bracket (21) and said single bracket (22) together, the pivot pins (23) of said pair of first bracket means (20) being aligned vertically with each other and with said shaft (13).

4. The swing motor mounting arrangement (10) of claim 1 wherein each of said second bracket means (26) includes a bracket (27) secured to said second frame (15) to extend rearwardly therefrom, a plate (28) having a respective end (14) of said shaft (13) secured thereto, and fastening means (29) for releasably securing said plate (28) to said bracket (27).

5. The swing motor mounting arrangement (10) of claim 4 wherein each end (14) of said shaft (13) is releasably secured to a respective plate (28) at a spline connection (31,32).

6. A backhoe swing motor mounting arrangement (10) comprising a mast frame (15), a tractor frame (16), a pair of first brackets (21) secured to said mast frame (15) to extend rearwardly therefrom, a pair of second brackets (22) secured to said tractor frame (16) to extend rearwardly therefrom in overlapping and separated relationship relative to said first brackets (21), a pivot pin (23) pivotally interconnecting each first bracket (21) with a respective second bracket (22), a swing motor (11) having a housing (12) and a shaft (13) rotatably mounted in said housing (12) and aligned with said pivot pins (23), said housing (12) connected solely to said tractor frame (16), and a pair of third brackets (27) separated from said first (21) and second (22) bracket and secured to said mast frame (15) to extend rearwardly therefrom and further secured solely to opposite ends of said shaft.

7. In a swing motor mounting arrangement (10) having a motor (11) including a housing (12) and a shaft (13) rotatably mounted in said housing (12), opposite ends (14) of said shaft (13) exposed at opposite ends of said housing (12), a first frame (16) having said housing (12) secured thereto, and a second frame (15) pivotally mounted on said first frame (16), the improvement comprising a pair of spaced first bracket means (20) for pivotally mounting said second frame (15) on said first frame (16) and a pair of spaced second bracket means (26) for securing the opposite ends (14) of said shaft (13) to said second frame (15) directly, each of said second bracket means (26) including a bracket (27) secured to said second frame (15) to extend rearwardly therefrom, a plate (28) having a respective end (14) of said shaft (13) secured thereto, and fastening means (29) for releasably securing said plate (28) to said bracket (27).

* * * * *